US010450691B2

(12) United States Patent
Choi

(10) Patent No.: US 10,450,691 B2
(45) Date of Patent: Oct. 22, 2019

(54) DRUM WASHING MACHINE

(71) Applicant: Samsung Electronics Co., Ltd, Gyeonggi-do (KR)

(72) Inventor: Han Kyu Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/300,260

(22) PCT Filed: Mar. 19, 2015

(86) PCT No.: PCT/KR2015/002674
§ 371 (c)(1),
(2) Date: Sep. 28, 2016

(87) PCT Pub. No.: WO2015/147481
PCT Pub. Date: Oct. 1, 2015

(65) Prior Publication Data

US 2017/0137989 A1 May 18, 2017

(30) Foreign Application Priority Data

Mar. 28, 2014 (KR) ..... 10-2014-0036447

(51) Int. Cl.
*E05D 7/04* (2006.01)
*E05D 3/06* (2006.01)
(Continued)

(52) U.S. Cl.
CPC ..... *D06F 39/14* (2013.01); *E05D 3/12* (2013.01); *E05D 7/00* (2013.01); *E05Y 2900/312* (2013.01)

(58) Field of Classification Search
CPC ..... D06F 39/14; D06F 39/12; D06F 37/10; D06F 37/26; D06F 37/28; E05D 3/12; E05D 3/127; E05D 7/00
See application file for complete search history.

(56) References Cited

U.S. PATENT DOCUMENTS 2,284,320 A * 5/1942 Howe ..... B60J 5/0495 16/250
2,309,001 A * 1/1943 Nave ..... E05D 3/02 16/379
(Continued)

FOREIGN PATENT DOCUMENTS

CN 1616749 A 5/2005
EP 1098027 A2 5/2001
(Continued)

OTHER PUBLICATIONS

International Search Report dated Jun. 16, 2015 in connection with International Application No. PCT/KR2015/002674, 5 pages.
(Continued)

*Primary Examiner* — Kimberley S Wright

(57) ABSTRACT

Disclosed are provided a drum washing machine having an improved coupling structure of a door and a cabinet.
A drum washing machine comprising: a cabinet forming an outer appearance of the drum washing machine, and having an opening into which laundry is put; a door configured to open and close the opening of the cabinet; a hinge assembly including a hinge shaft to support the door such that the door is rotatable with respect to the cabinet; and an reinforcement member configured to support the cabinet and the hinge assembly, and rotatably connected to the hinge shaft.

17 Claims, 5 Drawing Sheets

(51) Int. Cl.

| | |
|---|---|
| ***E05D 11/00*** | (2006.01) |
| ***D06F 39/14*** | (2006.01) |
| ***E05D 3/12*** | (2006.01) |
| ***E05D 7/00*** | (2006.01) |

(56) References Cited

U.S. PATENT DOCUMENTS 2,319,600 A * 5/1943 Heath ..... F25D 23/028 16/389
2,578,610 A * 12/1951 Stone ..... E05D 5/065 16/390
3,066,349 A * 12/1962 Youngdale ..... E05D 3/12 16/302
3,378,880 A * 4/1968 Haldopoulos ..... E05D 11/1014 16/337
3,883,201 A * 5/1975 Busoni ..... D06F 37/28 134/107
5,496,104 A * 3/1996 Arnold ..... A47L 15/4265 16/DIG. 14
5,685,046 A * 11/1997 Neag ..... E05D 3/127 16/366
6,196,617 B1 * 3/2001 Beck ..... B60J 5/105 16/331
6,938,444 B2 * 9/2005 Hong ..... D06F 39/14 134/200
7,551,873 B2 * 6/2009 Hiura ..... B65H 29/00 109/67
7,581,414 B2 * 9/2009 Kim ..... D06F 37/28 16/387
7,617,570 B2 * 11/2009 Hill ..... D06F 39/14 16/347
8,382,216 B2 * 2/2013 Favaro ..... D06F 39/14 16/286
8,733,863 B2 * 5/2014 Kwak ..... D06F 39/14 312/326
8,857,928 B2 * 10/2014 Coxon ..... D06F 39/14 312/328
8,936,331 B2 * 1/2015 Coxon ..... E05D 5/06 312/228
9,255,357 B2 * 2/2016 Bae ..... D06F 37/28
9,523,225 B2 * 12/2016 Smith ..... E05D 3/147
9,556,552 B2 * 1/2017 Park ..... D06F 39/14
2003/0172692 A1 * 9/2003 Hong ..... D06F 39/14 68/139
2005/0204510 A1 * 9/2005 Heimann ..... D06F 58/04 16/366
2006/0059710 A1 * 3/2006 Kim ..... D06F 58/04 34/603
2006/0156767 A1 * 7/2006 Kim ..... D06F 37/28 68/175
2006/0222435 A1 * 10/2006 Ha ..... H04N 1/00519 400/691
2007/0130730 A1 * 6/2007 Cho ..... D06F 39/14 16/387
2007/0220709 A1 * 9/2007 Hill ..... D06F 39/14 16/347
2008/0245112 A1 * 10/2008 Sung ..... D06F 39/14 68/12.26
2009/0064534 A1 * 3/2009 LeClerc ..... D06F 39/14 34/603
2009/0229316 A1 * 9/2009 Yoo ..... D06F 39/14 68/13 R
2010/0212112 A1 * 8/2010 Steurer ..... E05F 1/1261 16/286
2010/0295428 A1 * 11/2010 Favaro ..... D06F 39/14 312/228
2011/0120195 A1 * 5/2011 Jeoung ..... D06F 39/14 68/139
2012/0056518 A1 * 3/2012 Kwak ..... D06F 39/14 312/228
2013/0214660 A1 * 8/2013 Coxon ..... E05D 5/06 312/228
2013/0234573 A1 9/2013 Coxon
2014/0375188 A1 * 12/2014 Park ..... D06F 39/14 312/228

FOREIGN PATENT DOCUMENTS

| | | |
|---|---|---|
| JP | 2005143794 A | 6/2005 |
| JP | 2009112867 A | 5/2009 |
| KR | 20-0202030 | 8/2000 |
| KR | 10-2011-0057920 | 6/2011 |
| KR | 10-2012-0097307 | 9/2012 |

OTHER PUBLICATIONS

Written Opinion of the International Searching Authority dated Jun. 16, 2015 in connection with International Application No. PCT/KR2014/02674, 7 pages.
Office Action dated Nov. 8, 2018 in connection with Chinese Patent Application No. 201580012728.9, 17 pages.
Extended European Search Report regarding Application No. 157680943, dated Dec. 14, 2017, 8 pages.
First Office Action regarding Chinese Patent Application No. 201580012728.9, dated Feb. 24, 2018, 17 pages.
Communication pursuant to Article 94(3) EPC dated Apr. 11, 2019 in connection with European Patent Application No. 15 768 094.3, 5 pages.
Office Action dated Mar. 25, 2019 in connection with Chinese Patent Application No. 201580012728.9, 17 pages.

* cited by examiner

[Fig. 1]
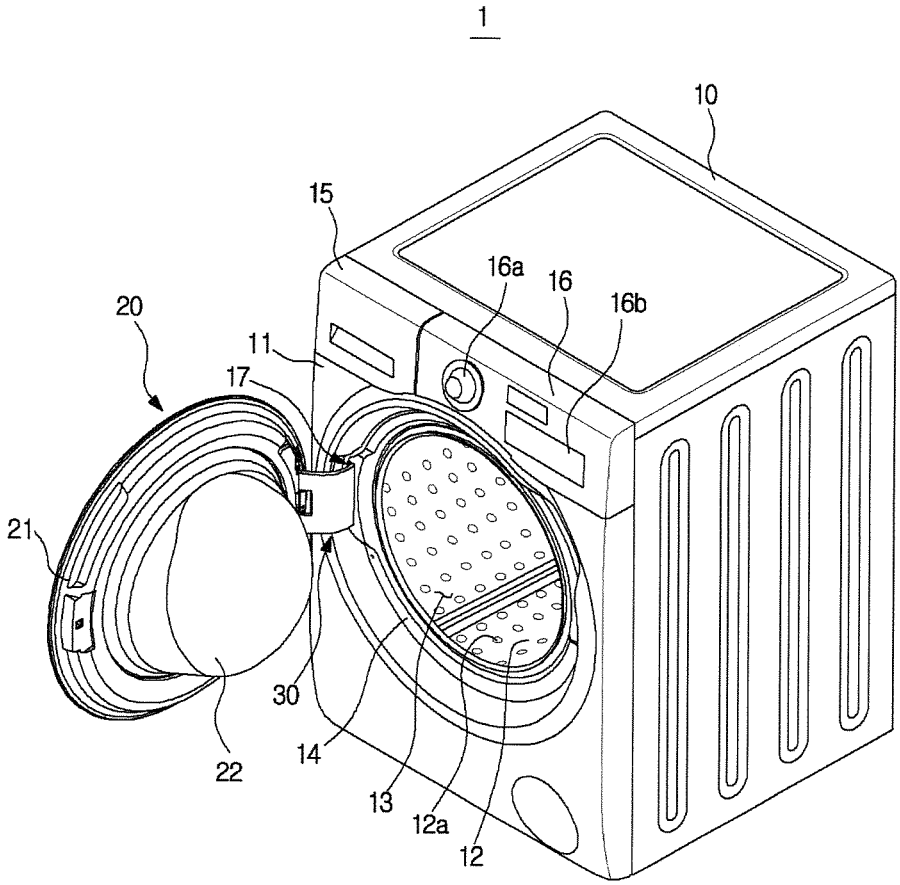

[Fig. 2]
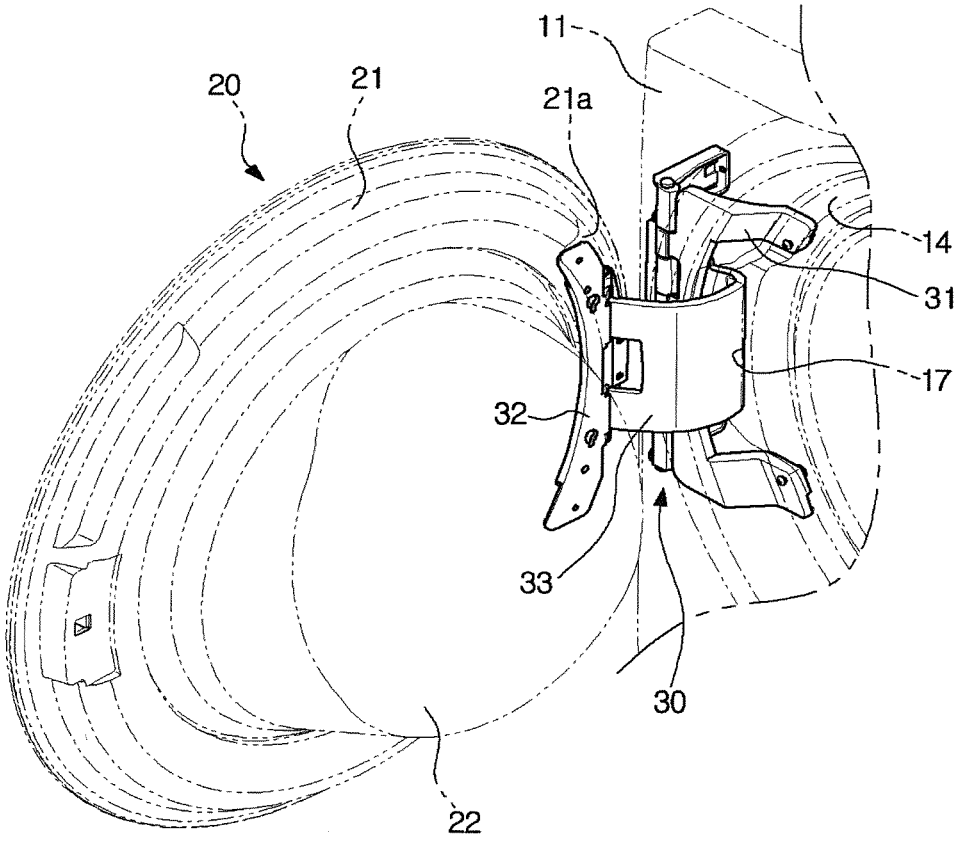

[Fig. 3]
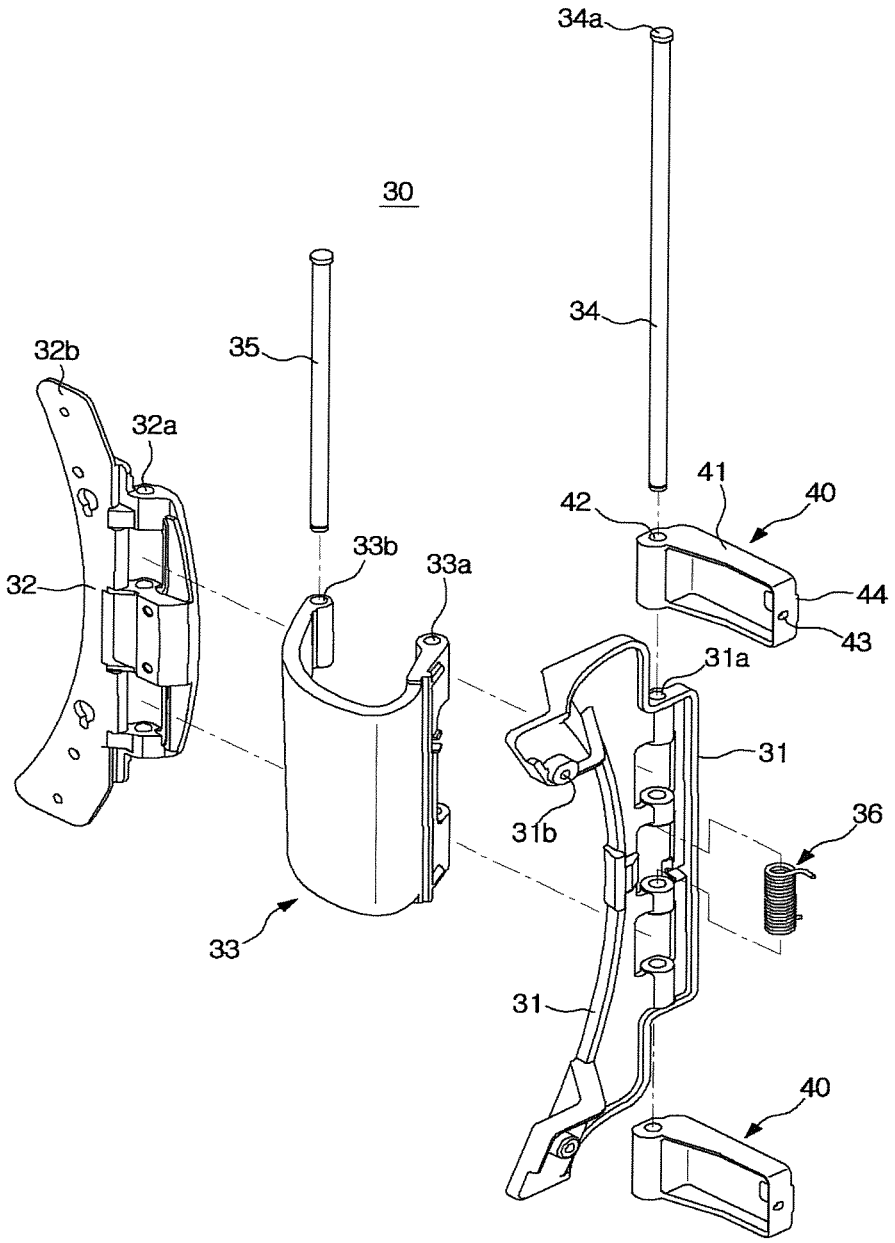

[Fig. 4]
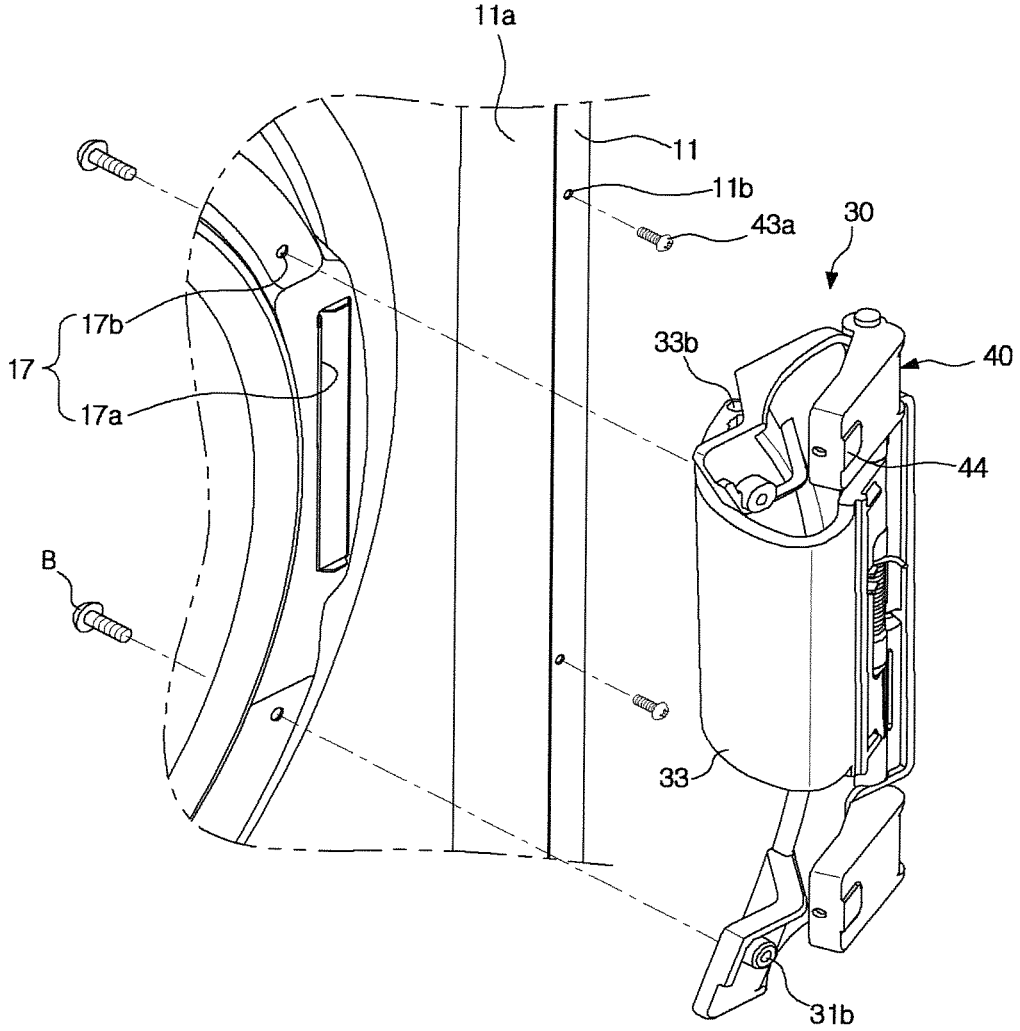

[Fig. 5]
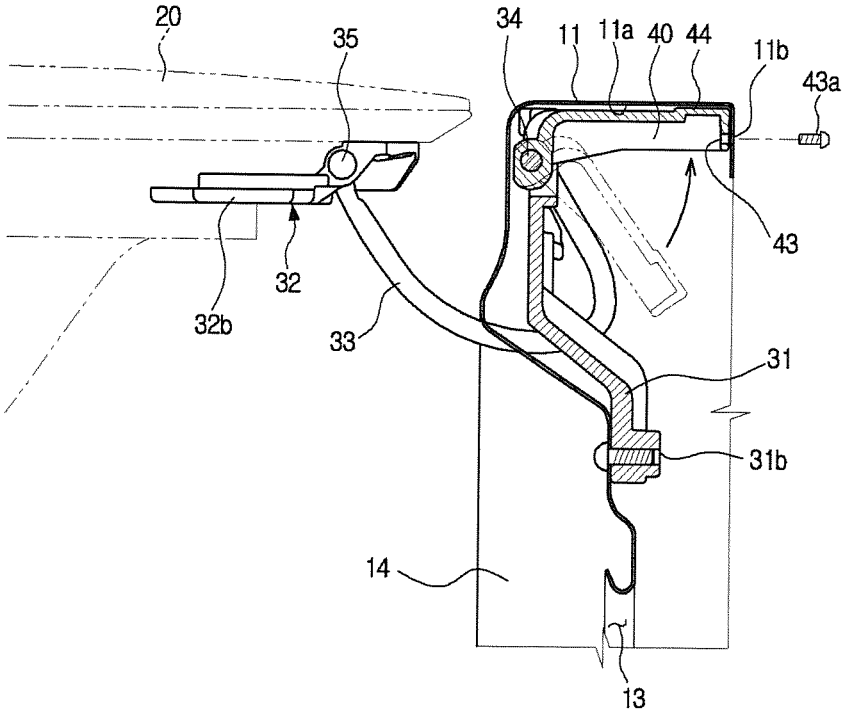

DRUM WASHING MACHINE

CROSS-REFERENCE TO RELATED APPLICATION(S)

The present application claims priority under 35 U.S.C. § 365 to International Patent Application No. PCT/KR2015/002674 filed Mar. 19, 2015, entitled "DRUM WASHING MACHINE", and, through International Patent Application No. PCT/KR2015/002674, to Korean Patent Application No. 10-2014-0036447 filed Mar. 28, 2014, each of which are incorporated herein by reference into the present disclosure as if fully set forth herein.

TECHNICAL FIELD

The present disclosure relates to a drum washing machine, and more particularly, to a drum washing machine having an improved coupling structure of a door and a cabinet.

BACKGROUND ART

In general, a washing machine is equipment of washing laundry by rotating a cylindrical rotating tub in which laundry and washing water are contained. Kinds of washing machines include a drum washing machine and a vertical axis type washing machine. In the drum washing machine, a rotating tub is positioned horizontally, and the rotating tub rotates in a forward direction with respect to the horizontal axis to raise laundry upward along the inner circumference surface and drop the laundry downward to thereby wash the laundry. In the vertical axis type washing machine, a rotating tub with pulsators therein is positioned vertically, and the rotating tub rotates in a forward direction with respect to the vertical axis so as for the pulsators to generate a stream of water, thereby washing laundry using the stream of water.

The drum washing machine includes a cabinet forming the outer appearance, a cylindrical tub which is installed in the inside of the cabinet and in which washing water is contained, a drum rotatably installed in the inside of the tub to wash laundry, a driving motor disposed behind the tub and configured to rotate the drum, and a door disposed in the front portion of the cabinet. In at least one part of the cabinet, an inlet communicating with the drum is provided, and the door opens and closes the inlet.

Typically, a structure of rotating the door to open the inlet is used. However, in this case, if the size of the door is large, the door could not open completely.

Also, the door is fixed on the frame of the cabinet by a hinge assembly, and due to the weight of the door and the friction generated when the door opens and closes, abrasion and deformation occur.

DISCLOSURE

Technical Problem

An aspect of the present disclosure is to provide a drum washing machine having an improved coupling structure of a door and a cabinet.

Another aspect of the present disclosure is to provide a drum washing machine including a reinforcement member for reinforcing the strength of a hinge assembly.

Still another aspect of the present disclosure is to provide a drum washing machine capable of improving workability when a hinge assembly is installed.

Technical Solution

In accordance with an aspect of the present disclosure, there is provided a drum washing machine comprising: a cabinet forming an outer appearance of the drum washing machine, and having an opening into which laundry is put; a door configured to open and close the opening of the cabinet; a hinge assembly including a hinge shaft to support the door such that the door is rotatable with respect to the cabinet; and an reinforcement member configured to support the cabinet and the hinge assembly, and rotatably connected to the hinge shaft.

Also, the drum washing machine according to claim 1, wherein the reinforcement member is rotatably coupled with the hinge shaft, and supported and fixed on the rear surface of the cabinet.

Also, the drum washing machine according to claim 1, wherein the reinforcement member comprises: a body; a hinge shaft coupling hole formed in one end of the body, and configured to pass the hinge shaft therethrough; and a fixing part formed at the other end of the body, and configured to fix the reinforcement member at the cabinet.

Also, the drum washing machine according to claim 3, wherein the fixing part comprises a screw, a rivet, welding, coking, and thermosetting.

Also, the drum washing machine according to claim 3, wherein the body further comprises a support rib formed on an outer circumference surface of the body, and configured to contact and support the cabinet.

Also, the drum washing machine according to claim 1, wherein a pair of reinforcement members are disposed at upper and lower portions of the hinge shaft.

Also, the drum washing machine according to claim 1, wherein the hinge assembly comprises: a first bracket coupled with the cabinet; a second bracket coupled with the door; and a connection unit rotatably connecting the first bracket with the second bracket, wherein the first bracket is coupled with the hinge shaft.

Also, the drum washing machine according to claim 7, wherein one end of the connection unit is connected to the hinge shaft of the first bracket, and the other end of the connection unit is connected to the second bracket.

Also, the drum washing machine according to claim 8, wherein the second bracket comprises a rotation shaft for rotating the door, and the connection unit is connected to the rotation shaft.

In accordance with another aspect of the present disclosure, a drum washing machine including a door rotatably coupled by a hinge assembly to open and close an opening formed in at least one part of a cabinet, wherein the hinge assembly comprises: a first bracket coupled with the cabinet; a second bracket coupled with the door; a connection unit having one end coupled with the first bracket by a hinge shaft, and the other end rotatably connected to the second bracket; and a reinforcement member having one end rotatably connected to the hinge shaft, and the other end fixed on the cabinet.

Also, The drum washing machine according to claim 10, wherein the reinforcement member comprises: a body; a hinge shaft coupling hole formed at one end of the body, and configured to pass the hinge shaft therethrough; and a fixing part formed at the other end of the body, and configured to fix the reinforcement member at the cabinet.

Also, the drum washing machine according to claim 11, wherein the fixing part of the reinforcement member comprises a screw, a rivet, welding, coking, and thermosetting.

Also, the drum washing machine according to claim 11, wherein the body further comprises a support rib formed on an outer circumference surface of the body, and configured to contact and support the cabinet.

Advantageous Effects

According to an embodiment of the present disclosure, by improving a coupling structure of the cabinet and the door, the door can be prevented from drooping and being deformed, resulting in an improvement of product quality.

Also, since the strength of the hinge assembly fixed on the cabinet can be reinforced by the reinforcement member, and the reinforcement member can rotate with respect to the hinge shaft to be installed on the cabinet, installability and workability can be improved.

BRIEF DESCRIPTION OF THE DRAWINGS

FIG. 1 is a perspective view of a drum washing machine having a door according to an embodiment of the present disclosure.

FIG. 2 is a perspective view schematically showing a hinge assembly according to an embodiment of the present disclosure.

FIG. 3 is an exploded perspective view showing a reinforcement member and a hinge assembly according to an embodiment of the present disclosure.

FIG. 4 is a perspective view showing coupling of a cabinet and a hinge assembly according to an embodiment of the present disclosure.

FIG. 5 is a perspective view showing coupling of a cabinet and a reinforcement member of a hinge assembly according to an embodiment of the present disclosure.

BEST MODE

Hereinafter, embodiments of the present disclosure will be described in detail with reference to the accompanying drawings.

FIG. 1 is a perspective view of a drum washing machine having a door according to an embodiment of the present disclosure;

As shown in FIG. 1, a drum washing machine 1 may include a cabinet 10 forming the outer appearance, a tub (not shown) installed in the inside of the cabinet 10 and configured to store washing water, and a cylindrical drum 12 rotatably installed in the inside of the tub, wherein a plurality of dehydrating holes are formed in the wall of the cylindrical drum 12.

In a front panel 11 disposed in the front portion of the cabinet 10, an opening 13 may be formed to enable a user to put or take laundry into or out of the inside of the tub (not shown) and the drum 12. The opening 13 may be opened or closed by a door 20 installed on the front panel 11 of the cabinet 10.

In the front panel 11 of the cabinet 10, a door contact member 14 contacting the door 20 when the door 20 closes the opening 13 may be provided. The door contact member 14 may be recessed in the inside direction of the drum washing machine 1, and formed along the border of the opening 13.

Also, the door contact member 14 may be formed to correspond to the shape of the door 20. Accordingly, a part protruding with respect to the surface of the cabinet 10 when the door 20 closes can be minimized, which leads to improvement of the beauty of the drum washing machine 1.

Also, at a part of the door contact member 14, a hinge assembly installing part 17 for installing the hinge assembly 30 which will be described later may be provided.

Meanwhile, although not shown in FIG. 1, a water supply pipe for supplying washing water to the inside of the tub may be installed in the top of the tub, wherein one end of the water supply pipe may connect to a water supply valve, and the other end of the water supply pipe may connect to a detergent case 15.

The detergent case 15 may connect to the drum 12 through a connection pipe, and water supplied through the water supply pipe may pass through the detergent case 15 and be supplied to the inside of the drum 12 together with detergent.

In the front portion of the drum 12, an opening may be formed to put or take laundry into or out of the inside of the drum 12, and in the rear portion of the drum 12, a motor (not shown) for driving the drum 12 may be provided.

In the lower portion of the cabinet 10, a drain unit (not shown) may be provided to discharge washing water filled in the inside of the tub to the outside of the drum washing machine 1. The drain unit may include a drain pump (not shown), a connection hose (not shown) connecting the tub to the drain pump to introduce water filled in the inside of the tub to the drain pump, and a drain hose (not shown) to guide water pumped by the drain pump to the outside of the drum washing machine 1.

In the upper portion of the front panel 11 of the cabinet 10, a control panel 16 may be provided. The control panel 16 may include a display window **16*b* to display the state of the drum washing machine 1, and an operating unit 16*a* to enable a user to control operations of the drum washing machine 1**.

The door 20 may include a door frame 21 forming the outer appearance of the drum washing machine 1, and a door glass 22 coupled with the rear portion of the door frame 21 and inserted into the inside of the opening 13 of the cabinet 10.

The door glass 22 may be configured to show the inside of the drum 12 in order for the user to be able to check laundry process with his/her naked eyes. The door glass 22 may preferably protrude in the rear direction of the cabinet 10.

The door frame 21 may include a hinge assembly 30 to couple the door 20 with the cabinet 10.

FIG. 2 is a perspective view schematically showing a hinge assembly according to an embodiment of the present disclosure, FIG. 3 is an exploded perspective view showing a reinforcement member and a hinge assembly according to an embodiment of the present disclosure, FIG. 4 is a perspective view showing coupling of a cabinet and a hinge assembly according to an embodiment of the present disclosure, and FIG. 5 is a perspective view showing coupling of a cabinet and a reinforcement member of a hinge assembly according to an embodiment of the present disclosure.

As shown in FIGS. 2 to 5, a hinge assembly 30 for connecting the door 20 rotatably with respect to the cabinet 10 may include a first bracket 31 coupled with the cabinet 10, a second bracket 32 coupled with the door 20, and a connection unit 33 connecting the first bracket 31 with the second bracket 32 and configured to rotate the door 20 in the front direction with respect to the cabinet 10.

The first bracket 31 may be coupled with the cabinet 10 through the hinge assembly installing part 17 formed in the front panel 11 of the cabinet 10.

The hinge assembly installing part 17 may be disposed in an area of the door contact member 14, and include a first installing part 17*a* through which the connection unit 33 passes, and a second installing part 17*b* which the first bracket 31 is coupled with and fixed at.

The first installing part 17*a* may preferably correspond to or be larger than the size of the connection unit 33 so that the connection unit 33 can pass through the first installing part 17*a* and rotate.

The second installing part 17*b* may be configured to couple the first bracket 31 with the front panel 11. There may be formed two second installing parts 17*b* above and below the first installing part 17*a*. A bolt B may be inserted into the second installing part 17*b* and fixed.

In the first bracket 31, an assembly hole 31*b* may be formed to assemble the bolt B to be fixed at the second installing part 17*b*.

In the first bracket 31, a hinge shaft hole 31*a* may be formed with which a hinge shaft 34 is coupled.

The hinge shaft 34 passing through the hinge shaft hole 31*a* of the first bracket 31 may include the connection unit 33 and an elastic member 36 connected to the center portion.

The elastic member 36 may support the hinge shaft 34 and the connection unit 33, and guide the movement of the connection unit 33.

In the second bracket 32, a door support part 32*b* installed on and supported by the door frame 21 of the door 20, and a rotation shaft hole 32*a* with which a rotation shaft 35 for rotatably supporting the door 20 is coupled may be formed.

In the door frame 21 of the door 20, a second bracket installing part 21*a* on which the second bracket 32 is installed may be formed.

Meanwhile, at both ends of the connection unit 33, a first coupling hole 33*a* coupled with the hinge shaft 34 of the first bracket 31, and a second coupling hole 33*b* coupled with the rotation shaft 35 of the second bracket 32 may be respectively formed.

One end of the connection unit 33 may be connected to the hinge shaft 34 of the first bracket 31 fixed on the rear surface 11*a* of the cabinet 10, and the other end of the connection unit 33 may be connected to the rotation shaft 35 of the second bracket 32 fixed on the door frame 21 of the door 20.

Accordingly, the door 20 may rotate with respect to the hinge shaft 34 rotatably fixed at one end of the connection unit 33, and may rotate by the rotation of the rotation shaft 35 coupled with the other end of the connection unit 33.

The door 20 may rotate in a front-back direction with respect to the opening 13 by the connection unit 33 moving horizontally with respect to the hinge shaft 34 of the hinge assembly 30, thus opening or closing the opening 13.

Meanwhile, in the hinge shaft 34 of the hinge assembly 30, a reinforcement member 40 for supporting the cabinet 10 and the hinge assembly 30 may be provided.

The reinforcement member 40 may have one end rotatably coupled with the hinge shaft 34 of the hinge assembly 30, and may be supported and fixed on the rear surface 11*a* of the cabinet 10.

The reinforcement member 40 may include a body 41, a hinge shaft coupling hole 42 which is formed at one end of the body 41 and into which the hinge shaft 34 is inserted, and a fixing part 43 formed at the other end of the body 41 to fix the reinforcement member 40 at the cabinet 10.

On the outer surface of the body 41, a support rib 44 may be formed to improve contact to the rear surface 11*a* of the cabinet 10. The support rib 44 may reinforce the strength of the reinforcement member 40.

The fixing part 43 of the reinforcement member 40 may be formed in one end of the body 41, and may be fixed by a fixing member 43*a* such as a bolt penetrating the fixing hole 11*b* formed in the front panel 11 of the cabinet 10.

In the current embodiment, the fixing part 43 of the reinforcement member 40 is fixed on the cabinet 10 by the fixing member 43*a* penetrating the fixing hole 11*b*, however, the concept of the present disclosure is not limited to this. For example, the reinforcement member 40 may be fixed by a screw, a rivet, welding, coking, thermosetting, etc.

A pair of reinforcement members 40 may be respectively installed at the upper and lower portions of the hinge shaft 34, and the hinge shaft 34 may include stoppers 34*a* protruding outward in order to prevent the reinforcement members 40 from being separated or deviating from the hinge shaft 34.

Now, a process of fixing the hinge assembly 30 on the cabinet 10 will be described with reference to FIGS. 4 and 5.

The first bracket 31 of the hinge assembly 30 may be fixed using the bolt B at the second installing part 17*b* of the hinge assembly installing part 17 formed in the rear surface 11*a* of the front panel 11.

One end of the connection unit 33 may pass through the first installing part 17*a*.

The reinforcement member 40 of the hinge shaft 34 may be disposed toward the first bracket 31.

If the first bracket 31 is fixed on the front panel 11, the reinforcement member 40 may rotate with respect to the rotation shaft 35 to contact the rear surface 11*a* of the front panel 11, and the reinforcement member 40 may be fixed on the front panel 11 through the fixing hole 11*b* of the front panel 11.

Since the hinge assembly 30 according to an embodiment of the present disclosure further includes a front panel fixing part through the fixing part 43 of the reinforcement member 40 in addition to a front panel fixing part through the assembly hole 31*b* of the first bracket 31, load applied to the hinge assembly 30 can be distributed, and accordingly, deformation can be prevented.

Meanwhile, if the first bracket 31 is fixed on the rear surface 11*a* of the front panel 11, the second coupling hole 33*b* of the connection unit 33 may be coupled with the second bracket 32 using the rotation shaft 35.

Fixing the reinforcement member 40 at the front panel 11 and fixing the second bracket 32 at the door 20 may be performed in this order or in the reverse order.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The invention claimed is:

1. A drum washing machine comprising:

a cabinet forming an outer appearance of the drum washing machine, and having an opening into which laundry is put;

a door configured to open and close the opening of the cabinet; and a hinge assembly comprising:

a hinge shaft to support the door such that the door is rotatable with respect to the cabinet;

a first bracket mounted to a first surface of the cabinet and coupled with the hinge shaft;

a second bracket mounted to the door;

a connection unit rotatably connecting the first bracket with the second bracket; and a reinforcement member mounted to a rear surface of the cabinet that has a different orientation from the first surface and configured to support the hinge assembly, the reinforcement member is rotatably connected to the hinge shaft and the reinforcement member is coaxial with the first bracket via the hinge shaft, wherein the reinforcement member comprises:

a body, a hinge shaft coupling hole formed in one end of the body, and configured to pass the hinge shaft therethrough, a fixing part formed at another end of the body, and configured to fix the reinforcement member to the cabinet, and a support rib on an outer circumferential surface of the body and configured to contact and support the cabinet.

2. The drum washing machine according to claim 1, wherein the rear surface is a rear inner surface of the cabinet.

3. The drum washing machine according to claim 1, wherein the fixing part comprises a fixing type selected from the group consisting of a screw, a rivet, welding, coking and thermosetting.

4. The drum washing machine according to claim 1, wherein the support rib supports the cabinet on a different surface of the cabinet from the fixing part.

5. The drum washing machine according to claim 1, wherein a pair of reinforcement members are disposed at upper and lower portions of the hinge shaft, and each reinforcement member is coaxial with the first bracket via the hinge shaft.

6. The drum washing machine according to claim 1, wherein one end of the connection unit is connected to the hinge shaft of the first bracket and coaxial with the first bracket and the reinforcement member via the hinge shaft, and another end of the connection unit is connected to the second bracket.

7. The drum washing machine according to claim 6, wherein the second bracket comprises a rotation shaft for rotating the door, and the connection unit is connected to the rotation shaft.

8. A drum washing machine including a door rotatably coupled by a hinge assembly to open and close an opening formed in at least one part of a cabinet, wherein the hinge assembly comprises:

a hinge shaft;

a first bracket coupled with a first surface of the cabinet;

a second bracket coupled with the door;

a connection unit having one end coupled with the first bracket by a hinge shaft, and another end rotatably connected to the second bracket; and a reinforcement member having one end rotatably connected to the hinge shaft, and another end fixed on a rear surface of the cabinet that has a different orientation from the first surface, wherein the first bracket, the connection unit and the reinforcement member are coaxial with each other via the hinge shaft, wherein the reinforcement member comprises:

a body, a hinge shaft coupling hole formed in one end of the body, and configured to pass the hinge shaft therethrough, a fixing part formed at another end of the body, and configured to fix the reinforcement member to the cabinet, and a support rib on an outer circumferential surface of the body and configured to contact and support the cabinet.

9. The drum washing machine according to claim 8, wherein the fixing part of the reinforcement member comprises a fixing type selected from the group consisting of a screw, a rivet, welding, coking and thermosetting.

10. The drum washing machine of claim 1, wherein the hinge assembly consists of a single hinge assembly such that the door is rotatable with respect to the cabinet via the single hinge assembly, and the reinforcement member supports the cabinet and the single hinge assembly.

11. The drum washing machine of claim 1, wherein the hinge assembly comprising the hinge shaft and a rotation shaft for a total of two shafts.

12. A drum washing machine, comprising:

a cabinet forming an exterior of the drum washing machine, wherein the cabinet has an opening for laundry;

a door for opening and closing the opening in the cabinet; and a single hinge assembly about which the door moves with respect to the cabinet, the single hinge assembly comprising:

a first bracket mounted to a first surface of the cabinet;

a reinforcement member mounted to a rear surface, which has a different orientation from the first surface, of the cabinet to support the single hinge assembly on the cabinet, a hinge shaft adjacent the cabinet and pivotably mounted to the reinforcement member, wherein the reinforcement member comprises:

a body, a hinge shaft coupling hole formed in one end of the body, and configured to pass the hinge shaft therethrough, a fixing part formed at another end of the body, and configured to fix the reinforcement member to the cabinet, and a support rib on an outer circumferential surface of the body and configured to contact and support the cabinet, and a rotation shaft adjacent the door.

13. The drum washing machine according to claim 12, wherein the rear surface is a rear inner surface of the cabinet.

14. The drum washing machine according to claim 12, wherein the rear surface is perpendicular to the first surface.

15. The drum washing machine according to claim 13, wherein the fixing part comprises a fixing type selected from the group consisting of a screw, a rivet, welding, coking and thermosetting.

16. The drum washing machine according to claim 1, wherein the rear surface is perpendicular to the first surface.

17. The drum washing machine according to claim 8, wherein the rear surface is perpendicular to the first surface.

* * * * *